US012426660B1

(12) United States Patent
McCue

(10) Patent No.: US 12,426,660 B1
(45) Date of Patent: Sep. 30, 2025

(54) INTELLIGENT PROTECTIVE HELMET SYSTEM WITH MODULAR SENSOR-INTEGRATED SHOCK-ABSORBING PADS

(71) Applicant: Geoff McCue, Tonganoxie, KS (US)

(72) Inventor: Geoff McCue, Tonganoxie, KS (US)

( * ) Notice: Subject to any disclaimer, the term of this patent is extended or adjusted under 35 U.S.C. 154(b) by 0 days.

(21) Appl. No.: 19/095,117

(22) Filed: Mar. 31, 2025

(51) Int. Cl.
*A42B 3/12* (2006.01)
*A42B 3/04* (2006.01)
*A42B 3/06* (2006.01)

(52) U.S. Cl.
CPC ..... *A42B 3/127* (2013.01); *A42B 3/046* (2013.01); *A42B 3/06* (2013.01)

(58) Field of Classification Search
CPC ..... A42B 3/127; A42B 3/046; A42B 3/06
See application file for complete search history.

(56) References Cited

U.S. PATENT DOCUMENTS 5,950,244 A * 9/1999 Fournier ..... A42B 3/128 2/425
6,272,692 B1 * 8/2001 Abraham ..... A42B 3/063 2/909
7,673,351 B2 * 3/2010 Copeland ..... A41D 31/285 2/425
9,439,468 B1 * 9/2016 Blagg ..... A42B 3/125
9,572,391 B2 * 2/2017 McInnis ..... A42B 3/124
9,642,410 B2 * 5/2017 Grice ..... A42B 3/06
11,229,254 B1 * 1/2022 Matteucci ..... A42B 3/063
11,638,456 B1 * 5/2023 Matteucci ..... A42B 3/063 2/414
2015/0047110 A1 * 2/2015 Chilson ..... A42B 3/281 29/283.5
2015/0143616 A1 * 5/2015 Steere ..... A42B 3/04 2/422
2017/0065018 A1 * 3/2017 Lindsay ..... A42B 3/067
2022/0361618 A1 * 11/2022 Ehret ..... A42B 3/062
2023/0354944 A1 * 11/2023 Petre ..... A42B 3/127

* cited by examiner

*Primary Examiner* — Tajash D Patel
(74) *Attorney, Agent, or Firm* — Sam Pierce

(57) ABSTRACT

A protective helmet system comprising a rigid outer shell formed with a plurality of through-holes distributed across its surface, each configured to receive a corresponding shock-absorbing pad that extends outwardly from the shell's exterior surface. The shock-absorbing pads are constructed from energy-dissipative materials and may vary in geometry, size, and composition based on the impact risk profile of specific helmet regions. One or more of the pads are operatively associated with internal sensors embedded within the helmet shell and shielded from environmental exposure. The sensors are configured to detect impact-related parameters including force magnitude, vector direction, and impact location. Sensor data is transmitted to a central controller embedded within the helmet, which is programmed to analyze, store, and optionally transmit the data to external monitoring systems in real time. The controller may further generate haptic or visual feedback in response to threshold-exceeding impacts.

17 Claims, 6 Drawing Sheets

INTELLIGENT PROTECTIVE HELMET SYSTEM WITH MODULAR SENSOR-INTEGRATED SHOCK-ABSORBING PADS

BACKGROUND OF THE INVENTION

Field of Invention

The present invention pertains to the field of personal protective equipment, and more particularly to helmet systems designed for mitigating cranial impact forces. Specifically, the invention relates to a protective helmet incorporating modular, externally mounted shock-absorbing elements coupled with internal sensor assemblies, the combination of which provides enhanced mechanical energy dissipation and real-time kinematic data acquisition for use in high-impact environments including, but not limited to, athletic activities, military operations, and industrial safety applications.

BRIEF SUMMARY OF THE INVENTION

The present invention discloses an intelligent protective helmet system comprising a rigid outer shell formed with a plurality of through-holes, each configured to receive a corresponding shock-absorbing pad that extends outwardly from the shell's external surface. The shock-absorbing pads are structurally and materially configured to attenuate impact forces prior to transmission to the helmet shell. Each pad may exhibit varying geometric configurations and material compositions to optimize performance across different helmet regions. Additionally, each pad may be operatively associated with an internal sensor positioned within the shell, wherein said sensor is adapted to detect impact-related data including, but not limited to, force magnitude, direction, and point of contact. The collected sensor data is electronically transmitted to an onboard controller configured to process, store, and relay the information to external systems, and optionally to generate haptic feedback to the wearer. This dual-function system offers both mechanical protection and real-time diagnostic capability, rendering the helmet particularly suitable for applications requiring advanced head impact monitoring and mitigation.

DETAILED DESCRIPTION

Figure 1:
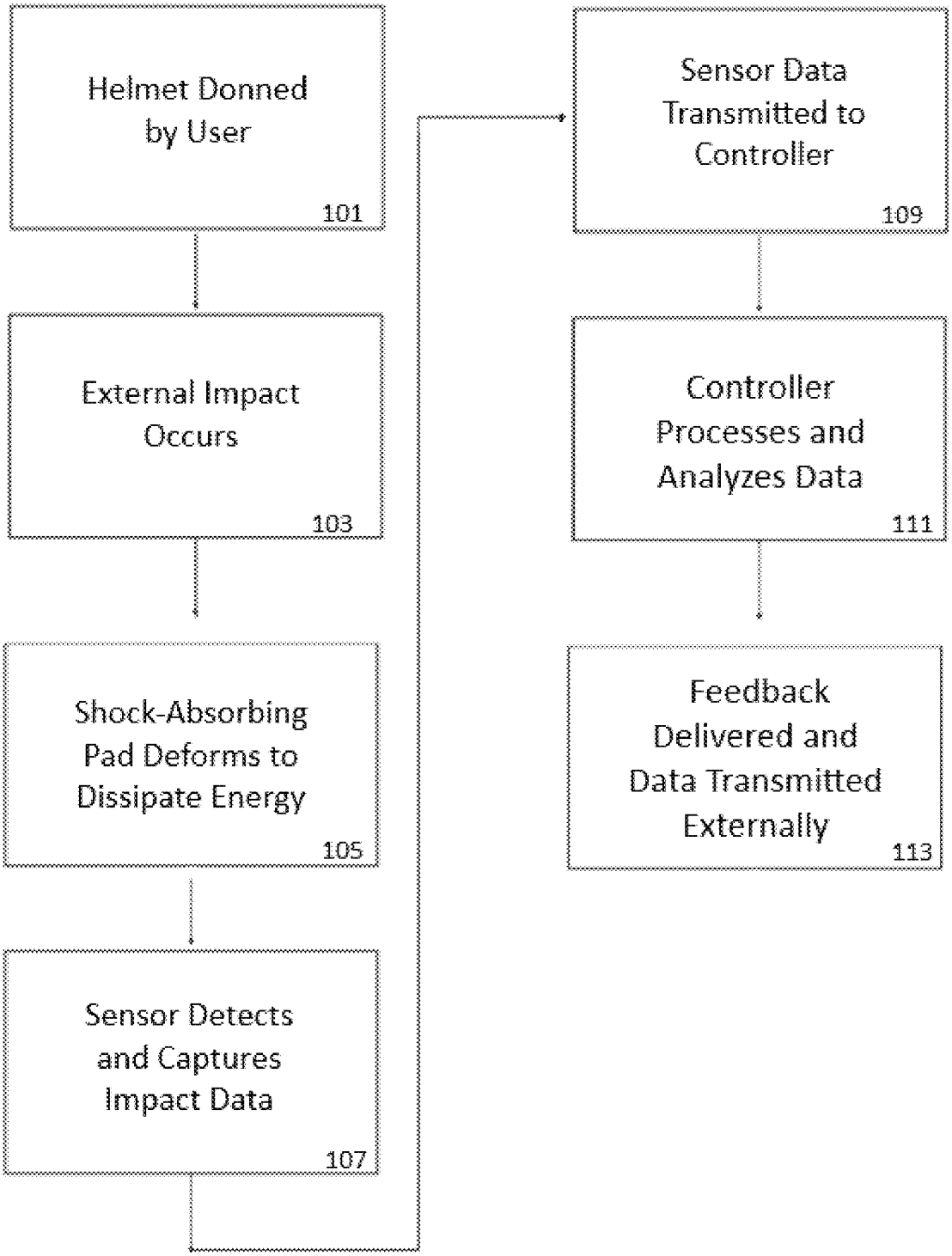
FIG. 1 illustrates the sequential process by which a user-worn helmet receives an impact (FIG. 1.103), mechanically dissipates force through deformable pads (FIG. 1.105), captures the event using embedded sensors (FIG. 1.107), transmits the data to an onboard controller (FIG. 1.109), processes and analyzes the data (FIG. 1.111), and delivers real-time feedback while transmitting data to external systems (FIG. 1.113) following initialization and donning of the helmet by the user (FIG. 1.101).

The protective helmet system disclosed herein comprises a unibody or multi-segmented outer shell (hereinafter "shell") constructed from a mechanically resilient, impact-resistant material selected from the group consisting of polycarbonate composites, aramid-reinforced polymers, carbon fiber laminates, high-density polyethylene (HDPE), acrylonitrile butadiene styrene (ABS), and other structurally analogous thermoplastic or thermoset resins known in the art. Said shell functions as the primary load-bearing structure of the helmet and is configured to distribute mechanical impact loads tangentially across its curved geometry, thereby reducing the direct transmission of kinetic energy to the wearer's cranium.

The shell is fabricated to incorporate a plurality of pre-formed or post-formed through-holes, apertures, or recesses (collectively, "receptacle ports"), each extending from the external surface to a predetermined depth into the shell body or fully through the shell wall. Said receptacle ports are strategically distributed across the surface area of the shell, including but not limited to the anterior, posterior, lateral, temporal, and parietal regions thereof, based upon empirical studies of cranial impact zones commonly encountered in high-contact environments. The quantity, positioning, and orientation of said receptacle ports may be algorithmically or heuristically determined based on biometric data, impact distribution heatmaps, and predictive modeling of likely collision vectors.

Each receptacle port is dimensioned to receive a shock-absorbing element, as described in Section 2 below, and is formed in geometric conformity with the shape of said element, e.g., cylindrical, prismatic, elliptical, or polygonal. The internal walls of each receptacle port may include structural reinforcement features, such as thickened perimeter rims, embedded inserts, overmolded collars, or integrally molded ridges configured to enhance the shear and torsional resistance of the shell in the vicinity of the openings, thereby preserving mechanical integrity in compliance with applicable protective headgear safety standards (e.g., NOCSAE, ASTM, or ANSI regulations).

The shell may be manufactured via injection molding, compression molding, resin transfer molding, or additive manufacturing, depending on the desired balance between mass production scalability and structural precision. In some embodiments, the receptacle ports are integrally molded during primary shell fabrication, whereas in alternative embodiments they are subsequently introduced via subtractive manufacturing methods, including but not limited to CNC drilling, water jet cutting, or laser ablation. Where post-fabrication drilling is employed, the structural perimeter of each port may be further reinforced via thermoplastic overmolding or insertion of annular reinforcing gaskets composed of high-durometer elastomers or metal alloys.

To facilitate the mechanical attachment and retention of shock-absorbing elements, the internal surfaces of the receptacle ports may be lined with friction-enhancing textures, mechanical interlocks, or threaded or snap-fit couplers. Adhesive bonding agents, thermally activated tapes, or reversible mechanical fasteners such as bayonet clips or detents may also be utilized to secure shock-absorbing pads into the receptacle ports while preserving field-replaceability.

The internal surface of the shell may further comprise a secondary structural layer—such as an energy-dispersive foam liner or viscoelastic interface matrix—affixed to the concave side of the shell for additional protection and wearer comfort. This secondary layer may contain wire routing channels, shock isolation mounts, or compartments configured to house sensor electronics, as detailed in subsequent sections. The shell may also be treated with antimicrobial coatings, abrasion-resistant finishes, or low-friction surface treatments to reduce shear stress in glancing impact scenarios.

The entirety of the shell and its receptacle port architecture is dimensioned to conform to ergonomic standards and cranial anthropometry, thereby ensuring that the addition of external shock-absorbing structures does not compromise the balance, fit, or wearability of the helmet. The helmet shell is further configured to support structural integration with existing helmet accessories, such as faceguards, chin straps, and internal head retention systems, without interference from the modular elements introduced by the present invention.

The protective helmet system further comprises a plurality of externally mounted, modular shock-absorbing elements (hereinafter "pads"), each of which is dimensioned, structured, and compositionally optimized to dissipate mechanical energy resulting from dynamic impact events before such energy propagates to the underlying helmet shell and, by extension, to the cranial region of the wearer.

Each pad is geometrically configured to correspond to the structural receptacle ports disposed on the helmet shell, as previously described in Section 1. The geometry of the pads may be selected from a non-limiting group of polyhedral and curved profiles, including but not limited to cylindrical, prismatic, spherical, hemispherical, cuboidal, hexagonal, and octagonal cross-sections. The outer surface of each pad may be either convex, concave, faceted, or undulated to modulate its surface area and contact behavior upon impact. The selection of a specific pad geometry at a given location on the shell may be determined by biomechanical impact data, with different geometries employed to alter compression dynamics, surface area engagement, and multidirectional deflection response.

Each pad comprises at least one primary energy-absorbing medium, herein referred to as the "core matrix," fabricated from a deformable, energy-dissipative material. Suitable materials for the core matrix include, but are not limited to, viscoelastic polyurethane foams, closed-cell ethylene vinyl acetate (EVA) foams, thermoplastic elastomers (TPE), thermoset silicone gels, shear-thickening polymers, and other compliant composites exhibiting high energy return hysteresis and strain-rate sensitivity. In some embodiments, the core matrix may be layered or laminated to achieve variable stiffness gradients along the depth axis of the pad, thereby providing a multi-stage deceleration profile tailored to specific impact velocity thresholds.

To improve mechanical durability and resistance to environmental degradation, each core matrix may be encapsulated within a protective sheath or housing composed of high-durometer elastomeric materials, thermoplastic polyurethanes (TPU), or aramid fiber-reinforced polymer shells. Said housing may further incorporate abrasion-resistant coatings, ultraviolet (UV) inhibitors, hydrophobic treatments, and antimicrobial additives to ensure long-term structural performance in field conditions.

Each pad is mechanically interfaced with the helmet shell by means of a reversible fastening mechanism that enables removal, replacement, or reconfiguration of the pad units in response to performance degradation or application-specific requirements. Exemplary fastening mechanisms include: (i) mechanical snap-fit couplings utilizing deformable tabs or retention ridges; (ii) threaded insert interfaces for rotational locking; (iii) semi-permanent adhesive bonding using pressure-sensitive adhesives or thermally activated bonding films; and (iv) hybrid magnetic-mechanical docking assemblies. The retention force of said fastening mechanisms is calibrated to withstand repetitive shear and tensile forces associated with incidental contact, glancing blows, and helmet-to-helmet collisions.

In an alternative embodiment, the pads may be configured as plug-in modules with self-aligning guides and integrated mechanical indexing features to ensure consistent installation orientation and directional integrity. To improve the stress distribution and prevent concentrated loading at the pad-shell junction, a compliant interface layer (e.g., an elastomeric gasket or viscoelastic buffer) may be disposed between the rear surface of the pad and the inner surface of the corresponding receptacle port.

The placement of the pads across the helmet shell is governed by impact probability mapping and user-specific risk profiling. Zones of high impact incidence—such as the frontal, lateral, and occipital regions—may be equipped with pads of increased thickness, higher-density core materials, or additional protective sublayers. Conversely, zones of low or infrequent impact exposure may be outfitted with thinner or more flexible pads to preserve aerodynamics and reduce unnecessary mass. The spatial distribution of the pads may be symmetrical or asymmetrical, depending on the intended activity profile and user preference.

To accommodate variations in user anthropometry and performance requirements, the pads may be produced in a plurality of interchangeable modules of differing material stiffness, geometric profiles, and sensor integration levels (as described in Section 3). This modular architecture allows for system-level customization by end users, field technicians, or manufacturers based on use-case requirements, such as age category, level of play, or medical history of prior head trauma.

In some embodiments, the pads may incorporate internal or surface-based airflow channels to facilitate ventilation and heat dissipation. Alternatively, perforated pad configurations or segmented designs may be employed to permit convective cooling without compromising structural integrity. Surface texture modifications—such as ribbing, cross-hatching, or micro-dimpling—may also be applied to the exterior face of the pads to reduce friction coefficients and mitigate rotational forces during angular impacts.

The combined effect of the pad architecture and strategic placement results in a protective system capable of dissipating linear and rotational forces in a controlled and repeatable manner, while also enabling post-impact data capture and helmet reconfiguration in response to observed performance, as further detailed in the subsequent sections.

The helmet system further comprises an integrated electronic architecture configured to facilitate real-time acquisition, processing, storage, and transmission of kinematic and dynamic data originating from one or more sensors embedded within or operatively associated with the shock-absorbing pads, as described in Section 3. This electronic subsystem is herein referred to as the "control system" or "controller," and it functions as the central data acquisition and feedback management unit within the helmet assembly.

The controller is embodied as a compact, low-power microcontroller or microprocessor-based module embedded within the helmet shell or housed within a structurally isolated compartment formed between the shell and the internal liner. In various embodiments, the controller is implemented using a system-on-chip (SoC) architecture comprising embedded memory, analog-to-digital conversion (ADC) modules, power management circuits, wireless transceivers, and optional digital signal processing (DSP) cores. The system is designed to operate under constrained thermal and mechanical loading conditions, and is encapsulated in a conformal coating or thermally stable enclosure to ensure resistance to vibration, moisture, and shock.

The controller is in operable communication with a plurality of sensor nodes, each of which comprises one or more sensor elements selected from the group consisting of tri-axial accelerometers, gyroscopes, strain gauges, piezoelectric force sensors, and microelectromechanical system (MEMS) pressure transducers. Said sensors are physically embedded within or adjacent to each pad's internal volume or receptacle interface, and are electrically routed to the controller via conductive traces, flexible printed circuits (FPCs), insulated wiring harnesses, or wireless sensor networks (WSNs), depending on the embodiment.

In a wired configuration, the helmet incorporates internal routing channels or embedded conduits to shield and direct electrical connections from each sensor to the central controller. In a wireless embodiment, the sensors may each include integrated radio frequency (RF) communication modules or operate as passive RFID/NFC elements powered by the controller's polling field or energy harvesting subsystems. Sensor identification codes, time-stamping, and data packet synchronization are managed by the controller through a predefined communication protocol stack, which may include variants of Bluetooth Low Energy (BLE), ZigBee, or proprietary sub-GHz telemetry standards depending on system requirements for latency, power consumption, and bandwidth.

Upon receipt of data from the sensor array, the controller performs a series of computational routines for preprocessing, filtering, and transformation. This includes signal conditioning operations such as noise rejection, normalization, and offset correction, followed by real-time data analytics including peak force identification, impulse vector determination, and cumulative impact load tracking. The controller may further execute embedded algorithms to compute derived metrics such as Head Injury Criterion (HIC), rotational acceleration thresholds, or concussion risk indices, depending on the capabilities of the onboard processing engine.

Processed data may be stored in local non-volatile memory (e.g., flash storage or FRAM) for onboard archival or subsequent extraction. Alternatively, the controller may be configured to initiate real-time data transmission to an external receiving device—such as a mobile phone, tablet, wearable diagnostic tool, or institutional server—via secure wireless communication. The transmission is optionally encrypted and compliant with relevant data privacy and medical device standards, such as HIPAA or GDPR, depending on deployment context.

In certain embodiments, the controller is further configured to trigger immediate feedback mechanisms in response to data exceeding predefined thresholds. Such feedback may be directed either to the end user—via haptic vibratory motors, audible tones, or visual indicators integrated into the helmet—or to third-party monitoring systems such as sideline diagnostic terminals, remote trainers, or automated emergency alert systems.

The controller also features an optional firmware update interface, enabling remote or local updates to be applied for purposes of algorithm enhancement, bug fixes, or feature deployment. Power to the controller may be supplied via a rechargeable lithium-polymer battery embedded within the helmet or via an inductive charging interface allowing for wireless charging through an external dock. In some variants, energy harvesting from kinetic motion or thermoelectric differentials may be employed as supplemental or alternative power sources.

System redundancy and fault tolerance are maintained through the use of error-detection and -correction protocols, watchdog timers, and fail-safe states designed to preserve system integrity in the event of signal loss, hardware failure, or impact-induced damage. Data integrity is further ensured through checksum verification and cyclical redundancy checking at both the sensor and controller levels.

Collectively, the electronic control system enables the helmet to function not merely as a passive protective device, but as an intelligent, self-monitoring platform capable of real-time impact analytics, performance diagnostics, and proactive safety alerting, thereby significantly advancing the state of the art in cranial protection systems.

The protective helmet system described herein is further characterized by its modular architecture and adaptability across a range of application domains, user profiles, and operational environments. This modularity pertains to the physical, electronic, and software components of the system, each of which may be reconfigured, replaced, or recalibrated to suit specific performance requirements, safety standards, or individualized user conditions.

At the physical level, the shock-absorbing pads are designed to be fully modular and field-replaceable. Each pad unit is configured to mechanically engage with its corresponding receptacle port through reversible coupling mechanisms, such as snap-fit interfaces, threaded attachments, or magnetic docking assemblies, as previously described in Section 2. This allows for rapid substitution or rearrangement of pad units based on wear degradation, environmental exposure, or changing impact risk profiles. For instance, a user engaging in high-collision athletic activity may opt to install thicker, high-durometer pads over the frontal and temporal regions of the shell, while a user in an industrial environment may select lower-profile pads that prioritize heat dissipation and range of motion.

The pads may be supplied in a range of modular configurations varying in geometric profile, core material, and integrated sensor capability. This enables customization based on activity-specific requirements. For example, football helmets may be configured with pads optimized for repeated moderate-force impacts, while military helmets may incorporate higher-stiffness pads for ballistic or blunt-force trauma resistance. The system may also be adapted for use in construction, firefighting, cycling, motorsports, or other contexts requiring cranial impact protection.

Sensor selection and placement are likewise customizable. Sensor-enabled pads may be distributed in user-defined patterns across the helmet shell, allowing for enhanced granularity of impact monitoring in known high-risk areas.

In some embodiments, sensor distribution templates may be generated using pre-participation biometric scans or historical impact data, enabling predictive configuration of the helmet's monitoring system. The modularity of the sensor architecture permits selective upgrade or replacement of individual sensor units without necessitating complete system overhaul.

Software and firmware parameters within the control system are also configurable, either locally or remotely, depending on implementation. The firmware governing the controller may include adaptive algorithms for threshold calibration, false-positive reduction, and user-specific alert sensitivity. For example, a youth athlete's helmet may be configured with lower force-detection thresholds and more conservative safety alerts, while a professional user's helmet may be tuned to emphasize data analytics and cumulative load monitoring. The controller may further integrate with third-party platforms or diagnostic tools via standardized application programming interfaces (APIs) or wireless communication protocols, enabling the helmet to function within a broader digital safety ecosystem.

To facilitate deployment in diverse operational contexts, the system may include interchangeable shells or shell overlays of varying size, material composition, or environmental resistance characteristics (e.g., UV protection, thermal insulation, chemical resistance). This enables the core functional system—comprising the pads, sensors, and controller—to be mounted onto application-specific shell variants without modification of internal components. In military variants, the helmet may integrate camouflage coatings and ballistic overlays; in industrial variants, high-visibility colors and flame-retardant materials may be employed.

The modularity of the system extends to manufacturing and distribution. The pads and sensors may be manufactured in standardized form factors for mass production or may be produced via additive manufacturing techniques for individualized helmet builds. Custom-fit helmet geometries may be generated from cranial scans, enabling precise alignment of pads and sensors based on unique anatomical contours and susceptibility profiles. This supports individualized protective performance for users with previous head injuries, asymmetrical cranial features, or medical conditions requiring tailored cranial protection.

From a regulatory standpoint, the modular design facilitates certification and compliance across multiple standards by allowing for targeted testing of components. Individual pad materials may be tested for compression resistance under ASTM or ISO standards, while the shell may be certified under NOCSAE or EN standards. The ability to interchange components without affecting overall structural integrity allows manufacturers and end users to maintain compliance through selective component replacement or upgrade.

Additionally, the system may include a configuration management interface—either via a mobile application or cloud-based dashboard—that enables coaches, safety officers, or medical personnel to monitor the configuration state of each helmet, including pad type, sensor placement, firmware version, and usage history. This system may optionally include automated alerts when specific components require replacement based on usage data or elapsed service life.

In sum, the modularity and customization features of the present invention enable the helmet system to transcend traditional, static protective gear and function as a dynamically reconfigurable safety platform. By permitting adaptable configuration across hardware and software layers, the invention ensures sustained protective efficacy, broad market applicability, and individualized risk mitigation in a wide array of real-world scenarios.

DETAILED DESCRIPTION OF FIGURES

FIG. 1.101—Helmet Donned by User

The protective helmet system is securely positioned on the user's head, with the adjustable internal retention system engaged to ensure proper fitment. The embedded controller is initialized, and all modular components—including shock-absorbing pads and sensor arrays—are in standby mode, awaiting activation upon detection of motion or force thresholds.

FIG. 1.103—External Impact Occurs

A mechanical impact force is applied to the outer region of the helmet shell. This force may originate from blunt trauma, collision, or incidental contact encountered during sport, industrial activity, or military engagement. The impact propagates toward the point of contact on the helmet's exterior.

FIG. 1.105—Shock-Absorbing Pad Deforms to Dissipate Energy

Upon receiving the impact, the shock-absorbing pad located at or near the impact site undergoes elastic and/or plastic deformation, thereby converting kinetic energy into heat and mechanical displacement. The geometry and material properties of the pad serve to minimize the magnitude of force transmitted to the underlying shell.

FIG. 1.107—Sensor Detects and Captures Impact Data

The sensor operatively associated with the affected pad registers the impact via measurement of dynamic variables including linear acceleration, angular velocity, pressure, or strain. Sensor output is converted to electrical signals representing quantitative metrics of the impact event.

FIG. 1.109—Sensor Data Transmitted to Controller

The electrical signals from the sensor are routed via internal wiring or wireless communication pathways to the controller embedded within the helmet. Data packets are transmitted with time-stamping and pad-origin metadata to preserve spatial correlation with the impact site.

FIG. 1.111—Controller Processes and Analyzes Data

The controller performs computational routines to parse raw sensor data, isolate peak impact values, determine directional vectors, and compare measured values against pre-set safety thresholds. Optionally, it computes predictive injury indicators such as concussion risk or cumulative trauma score.

FIG. 1.113—Feedback Delivered and Data Transmitted Externally

If the analyzed data exceeds predetermined thresholds, the controller triggers haptic or audible feedback to the user and transmits the impact event data wirelessly to an external device such as a tablet, smartphone, or medical monitoring station. Data may be archived locally or uploaded for remote access.

Figure 2:
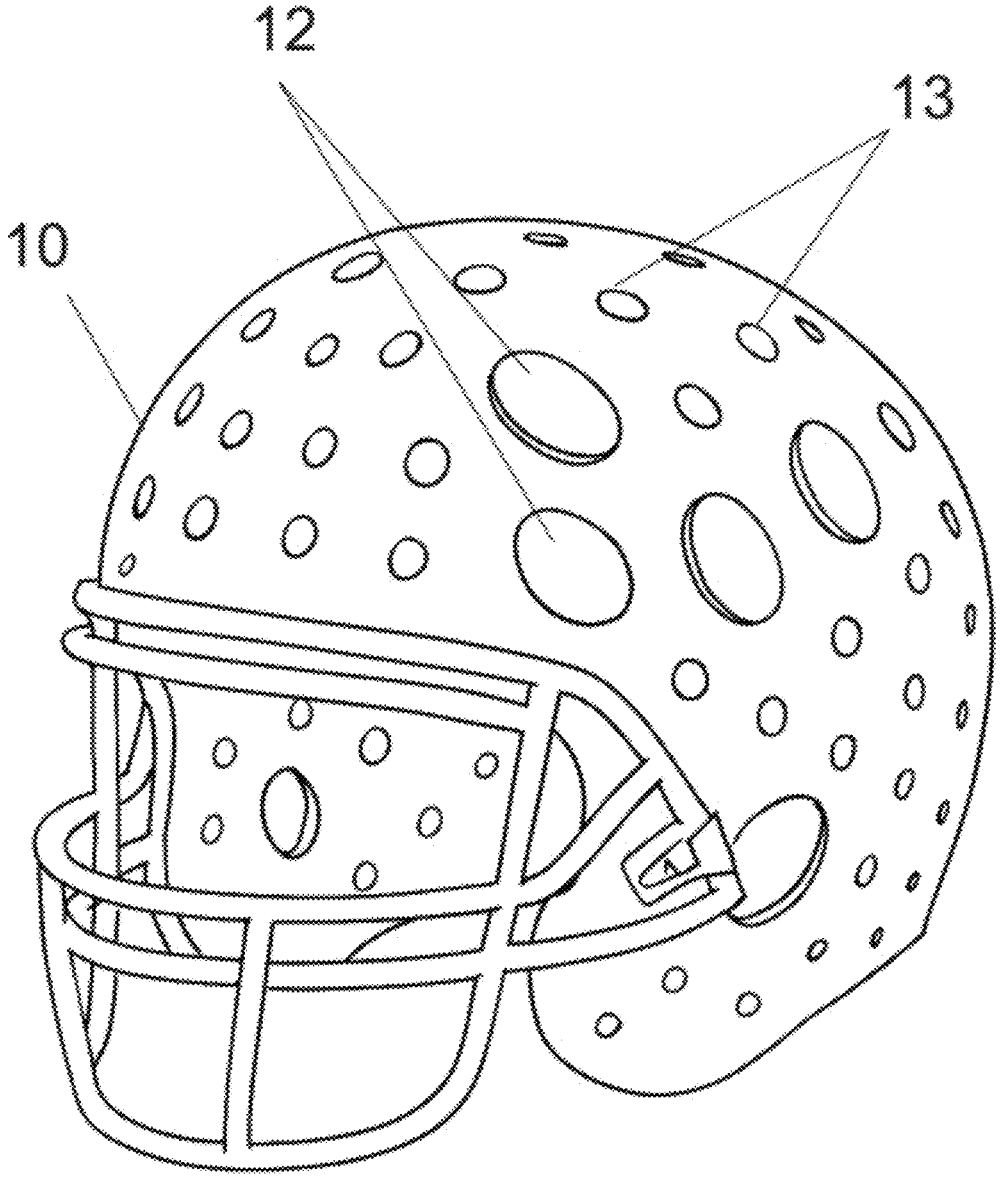
FIG. 2 is a perspective view of the helmet system illustrating the distribution of modular shock-absorbing pads protruding from apertures formed across the crown, lateral, and posterior surfaces of the helmet shell.

FIG. 2—Perspective View of Helmet with Pads Installed

FIG. 2 depicts a three-dimensional perspective view of the protective helmet system, wherein the helmet shell 10 is shown with a plurality of shock-absorbing pads 13 installed in receptacle ports disposed throughout the crown, lateral (side), and occipital (rear) regions. The pads 13 are visibly protruding from circular openings in the shell 10, and their external positioning is configured to maximize exposure to primary impact vectors. The uniform spacing of the pads reflects a standard configuration, though it is understood that such positioning may be modified in accordance with impact zone risk profiling. Each pad 13 is mounted to extend outwardly from the helmet shell to absorb and dissipate energy prior to contact with the rigid structure of the shell itself.

Figure 3A:
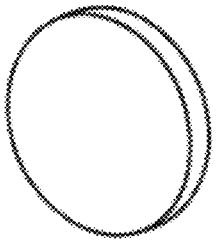
FIGS. 3A through 3C illustrate exemplary geometries of shock-absorbing pads, including circular (3A), rectangular (3B), and octagonal (3C) configurations, each compatible with the helmet shell's modular mounting system.
Figure 3B:
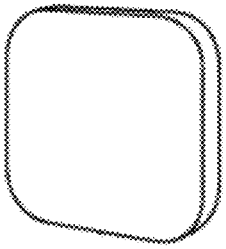
Figure 3C:
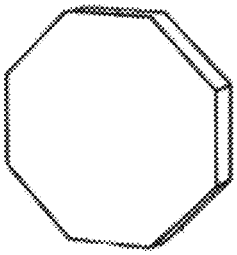

FIGS. 3A—3C-Pad Geometry Variants

FIGS. 3A-3C illustrate representative examples of various pad geometries intended for integration with the helmet system. In FIG. 3A, the pad is shown as a circular profile, optimized for uniform force distribution and rotational symmetry. In FIG. 3B, the pad features a rectangular configuration, which may be beneficial in coverage of broader surface areas or alignment along linear structural features of the helmet shell. FIG. 3C shows an octagonal pad design, providing a compromise between curvature and flat surface interface while maximizing edge reinforcement. Each geometric variant may be manufactured to fit corresponding receptacle ports on the helmet shell 10 and may include internal interfaces for sensor integration as described in subsequent figures.

Figure 4A:
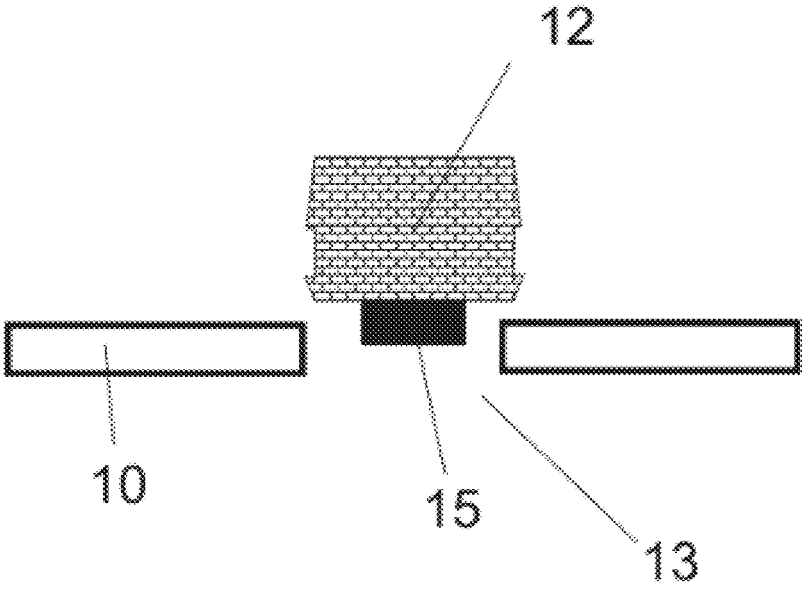
FIGS. 4A and 4B present exploded views of a shock-absorbing pad assembly, showing alignment of the helmet shell 10, pad 12, mounting aperture 13, and internal sensor housing 15 for impact data acquisition.
Figure 4B:
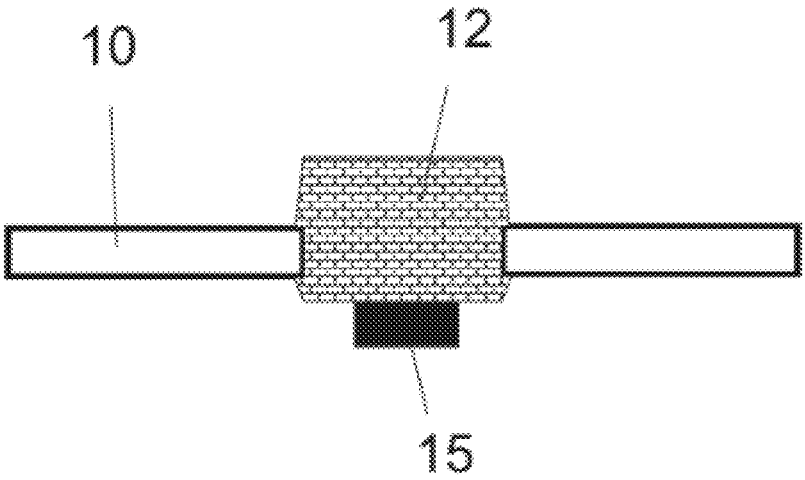

FIGS. 4A-4B—Exploded Pad Assembly

FIGS. 4A-4B illustrate an exploded view of a modular shock-absorbing pad assembly. The helmet shell 10 includes a through-hole 13 configured to receive the pad 12. The pad 12 is shown aligned for insertion into the aperture 13, with the inner surface of the pad or its interface structure in communication with a sensor housing 15 located within or adjacent to the helmet shell interior. The sensor housing 15 may be integrated directly into the back of the pad or embedded in the helmet wall to isolate and protect the electronic components. This figure clarifies how each pad module not only serves a mechanical function but also acts as an interface point for sensorized data acquisition, forming an integral part of the smart helmet system.

Figure 5:
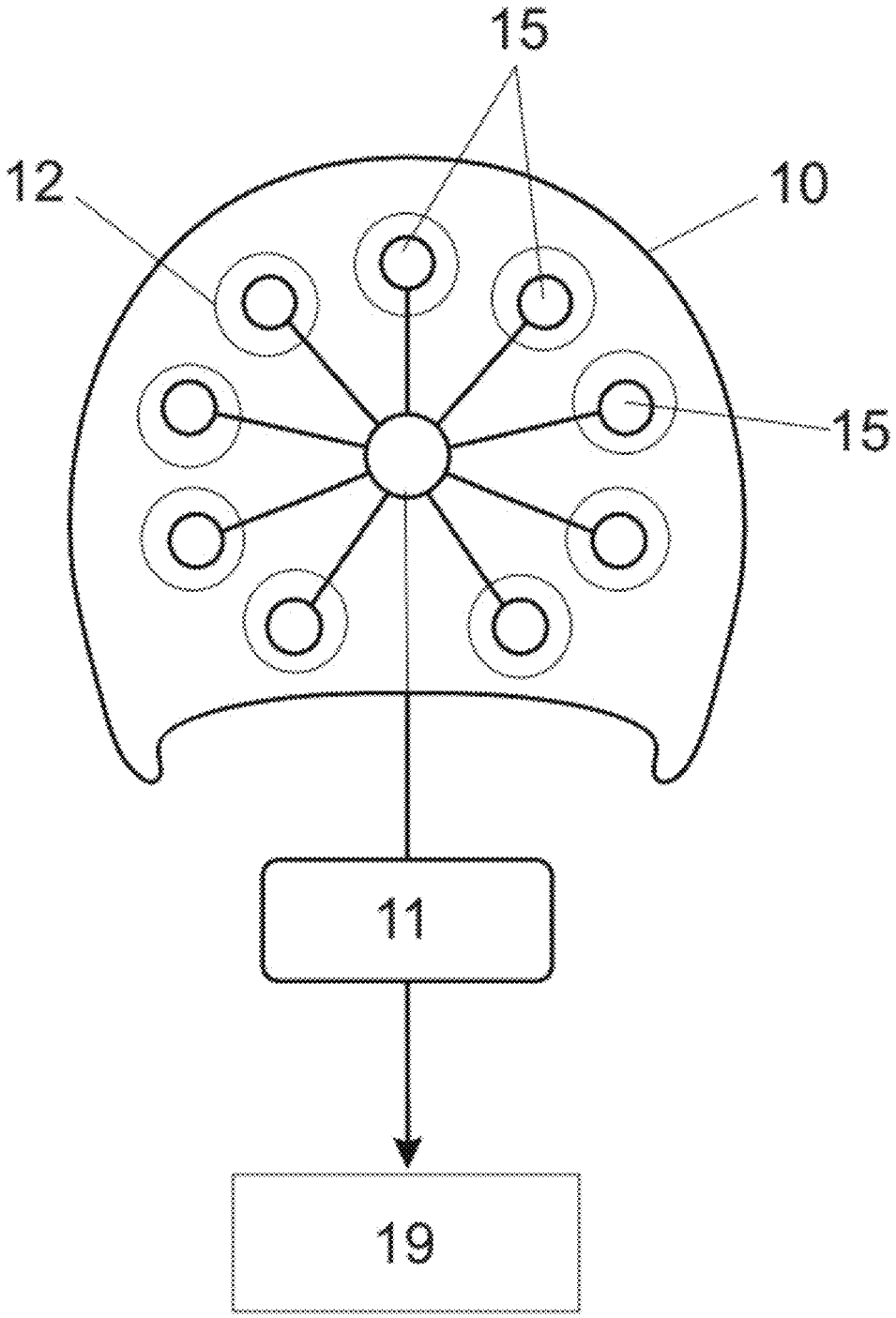
FIG. 5 is a top-down schematic view illustrating the internal sensor network, in which multiple sensors 15 are electrically connected and routed to a central processing controller 11 located within the helmet shell.

FIG. 5—Sensor Network Wiring Diagram

FIG. 5 provides a top-down schematic view of the internal electronics architecture of the helmet system, demonstrating how multiple sensors 15, each corresponding to individual shock-absorbing pads, are operatively connected via an internal wiring harness or flexible circuit system. These sensors 15 are routed to a central processing controller 11, which may be embedded within the helmet shell or housed in a detachable, serviceable module. The figure illustrates routing pathways, electrical nodes, and junction points that maintain reliable data transfer integrity while minimizing obstruction to helmet ventilation or structural performance. The configuration may also support redundancy or fault isolation protocols to ensure system resilience in high-impact conditions.

Figure 6:
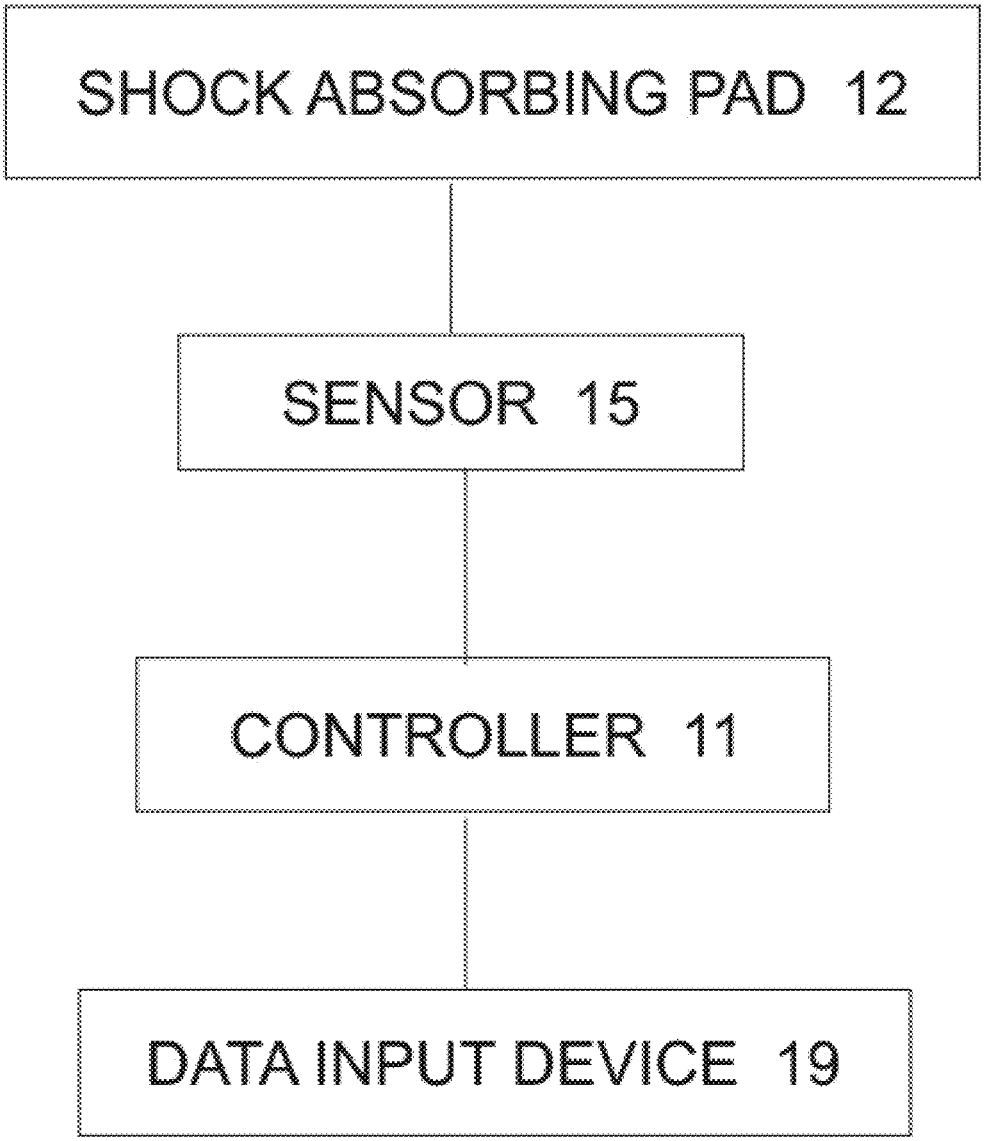
FIG. 6 is a system-level diagram depicting the end-to-end data capture and feedback process, showing how sensor data is collected, processed by the controller, and transmitted to external systems 19 including user devices and monitoring platforms.

FIG. 6—Data Capture and Feedback Flow Diagram

FIG. 6 illustrates the full data handling pipeline for the intelligent helmet system. Upon impact, sensors embedded within or adjacent to the pads detect force metrics and transmit the corresponding electrical signals to the central controller 11. The controller then processes the data using onboard analytics routines and assesses whether thresholds for injury risk or force magnitude have been exceeded. Depending on the results, the controller may initiate a local haptic response (e.g., vibration) to the user and simultaneously transmit the event data to external systems 19 such as mobile devices, tablets, or medical monitoring platforms via a wireless communication protocol. This figure highlights the real-time nature of the helmet's diagnostic functionality, as well as its potential for integration into broader athlete safety or occupational hazard monitoring ecosystems.

What is claimed is:

1. A protective helmet system comprising:

a. a helmet shell formed from an impact-resistant material and having a plurality of non-uniform through-holes disposed across its surface;

b. two or more shock-absorbing pads selected from at least two of square, circular and oval shapes, each pad configured to be selectively received in a respective non-uniform through-hole and to protrude outward from an exterior surface of the helmet shell; and c. at least one sensor operatively associated with at least one of the shock-absorbing pads, wherein the sensor is positioned on an interior side of the helmet shell and configured to detect impact-related data, d. wherein each shock-absorbing pad is configured to absorb and dissipate impact energy before transmission to the helmet shell.

2. The protective helmet system of claim 1, wherein the shock-absorbing pads are removably secured to the helmet shell using a coupling mechanism selected from the group consisting of snap-fit interfaces, threaded attachments, mechanical fasteners, adhesive bonds, and magnetic docking assemblies.

3. The protective helmet system of claim 1, wherein each shock-absorbing pad is formed from a material selected from the group consisting of viscoelastic foam, thermoplastic elastomer, silicone gel, polyurethane foam, and shear-thickening polymer.

4. The protective helmet system of claim 1, further comprising one or more shock-absorbing pads with geometries selected from the group consisting of cylindrical, spherical, cuboidal, prismatic, and polygonal configurations.

5. The protective helmet system of claim 1, wherein the sensor is selected from the group consisting of accelerometers, gyroscopes, strain gauges, pressure transducers, and piezoelectric force sensors.

6. The protective helmet system of claim 1, further comprising a controller operatively connected to the sensor, the controller configured to receive, process, and store data transmitted from the sensor.

7. The protective helmet system of claim 6, wherein the controller is further configured to transmit data to an external device via a wireless communication protocol.

8. The protective helmet system of claim 6, wherein the controller is further configured to provide real-time haptic feedback to a wearer of the helmet in response to sensor data exceeding a predetermined threshold.

9. The protective helmet system of claim 1, wherein the shock-absorbing pads are arranged across the helmet shell in a pattern corresponding to predetermined impact risk zones.

10. The protective helmet system of claim 1, wherein at least one of the shock-absorbing pads comprises an outer protective housing encapsulating an energy-absorbing core.

11. The protective helmet system of claim 1, wherein the helmet shell further comprises internal routing channels configured to house electrical connections between the sensors and the controller.

12. The protective helmet system of claim 1, wherein the helmet shell and pads are configured to be modular, allowing for user customization based on activity type, impact exposure profile, or regulatory standard.

13. A method of protecting a wearer from cranial impact, the method comprising:

forming a helmet shell having a plurality of non-uniform through-holes across its surface;

inserting two or more shock-absorbing pads selected from at least two of square, circular and oval shapes into the respective non-uniform through-holes such that each pad protrudes outward from the helmet shell;

sensing impact data via sensors positioned inside the helmet shell and operatively coupled to at least one of the pads;

transmitting the sensed impact data to a controller for real-time monitoring and feedback.

14. The method of claim 13, further comprising configuring the controller to transmit the impact data to an external monitoring device in real-time.

15. The method of claim 13, further comprising adjusting the material, thickness, or geometry of the shock-absorbing pads based on a location-specific risk analysis.

16. The method of claim 13, further comprising replacing one or more of the shock-absorbing pads with alternate pads to suit a different user profile or activity type.

17. The method of claim 13, further comprising triggering a haptic or visual alert upon detection of an impact exceeding a predetermined threshold.

* * * * *